US005605027A

United States Patent [19]

Scroggin et al.

[11] Patent Number: 5,605,027

[45] Date of Patent: Feb. 25, 1997

[54] PACKAGING MACHINE WITH SIDE FLAP GLUING AND FOLDING CAPABILITY

[75] Inventors: Daniel J. Scroggin, Portland; John L. Raudat, Madison, both of Conn.

[73] Assignee: Standard-Knapp, Inc., Portland, Conn.

[21] Appl. No.: 563,934

[22] Filed: Nov. 29, 1995

Related U.S. Application Data

[62] Division of Ser. No. 332,974, Nov. 10, 1994, abandoned.

[51] Int. Cl.[6] ..... B65B 51/10

[52] U.S. Cl. ..... 53/377.2; 53/376.4

[58] Field of Search ..... 53/373.5, 376.3, 53/376.4, 376.5, 376.7, 377.2, 251, 252

[56] References Cited

U.S. PATENT DOCUMENTS

| | | | |
|---|---|---|---|
| 4,131,058 | 12/1978 | Graham | 53/377.2 |
| 4,503,659 | 3/1985 | Sherman | 53/376.5 |
| 4,562,687 | 1/1986 | Green, Jr. | 53/376.5 |
| 5,339,599 | 8/1994 | Risnes | 53/252 |
| 5,379,573 | 1/1995 | Greenwell | 53/376.5 |
| 5,417,032 | 5/1995 | Calvert et al. | 53/376.4 |

FOREIGN PATENT DOCUMENTS

| | | | |
|---|---|---|---|
| 0561611 | 9/1993 | European Pat. Off. | 53/376.7 |

*Primary Examiner*—Horace M. Culver
*Assistant Examiner*—Ed Tolan
*Attorney, Agent, or Firm*—McCormick, Paulding & Huber

[57] ABSTRACT

An inline packaging machine for folding the flaps of a paper board tray blank around a group of articles loaded on the bottom panel of the tray has provision for emergency shut-down whereby any glue applied to the side flaps of the tray will not set before the tray is completely formed. Moveable side flap folding means is provided at the glue station itself for this purpose. The said emergency flap folding means also serves to support the tray end flaps during gluing. The compression section of the machine that normally applies pressure to the glued flaps includes an inlet portion that is re-configured during emergency shut-down for the same purpose, that is to assure that the flaps are completely folded as the glue sets. The glue station and compression section are mounted on beams that are movable toward and away from one another to accommodate trays of various width.

6 Claims, 10 Drawing Sheets

PACKAGING MACHINE WITH SIDE FLAP GLUING AND FOLDING CAPABILITY

CROSS REFERENCE TO RELATED APPLICATIONS

This application is a divisional of an application by the same inventors filed Nov. 10, 1995 under Ser. No. 332,974 now abandoned.

BACKGROUND OF THE INVENTION

The present invention relates to packaging machines of the type adapted to handle groups of articles on flat tray blanks which tray blanks have leading and trailing flaps to be folded in a conventional fashion, and side flaps that are glued and folded against corner tabs provided on these leading and trailing flaps. More specifically, the present invention relates to a unique side flap folding and gluing mechanism capable of abrupt shut-down of the machine without leaving the side flaps unfolded after being glued. Normally a tray can be stopped at the glue station prior to entry into the conventional compression section of the machine, and will be left unfolded but glued. Such a situation requires intervention by the machine operator before the machine can be restarted.

DESCRIPTION OF THE PRIOR ART

Packaging machines of the type adapted to pack groups of articles in trays or the like, where the articles move continuously in a downstream direction through a load station and then through a glue station, generally include means downstream of the glue station for folding the glued side flaps of the tray in a compression section of the machine.

Such continuous motion high speed tray loading machines must be shut down periodically either in the event of an emergency or for other reasons. Heretofore shutdowns of this type have required sacrificing partially packaged units in the machine. In the event that a particular unit has been glued but not yet advanced into the compression section of such a machine for final folding the quick setting adhesive or other glue will not serve its intended function when the machine is restarted. Thus, the operator of the machine must take the time and trouble to remove that particular unit from the machine prior to start up after such an emergency or abrupt stop.

SUMMARY OF THE INVENTION

The general purpose of the present invention is to provide a gluing and folding mechanism for a packaging machine of the continuous motion type where each package unit proceeds continuously through the machine, and through a glue station into a compression section for setting the adhesive and holding the various flaps in position long enough to provide time for the glue or adhesive to set. More specifically, the present invention relates to an improved gluing and folding mechanism designed to avoid the problem presented by package units which are stopped at or near the glue station so as to cause the glue or adhesive to set prior to entry into the folding and compression section of the machine.

The present invention accomplishes the above stated result by providing conventional side flap gluing means for applying glue to the side flaps at the glue station, and conventional side flap folding plows downstream of said side flap glue station for holding the side flaps in position to set the glue in a conventional compression section. Emergency side flap folding means is providing at the glue station, and is selectively operable to move the side flaps into folded positions when the machine is stopped abruptly. The side flap folding plows include a conventional fixed portion defining the conventional compression section for the glued and folded side flaps, and the side flap folding plows of the present invention further include moveable inlet plow portions that are normally positioned to define a funnel shaped inlet for the glued flaps entering the compression section. These inlet plow portions are also moveable into emergency positions aligned with the conventional side flap folding fixed plow portions of the compression section. Emergency side flap folding means is also provided for movement from inactive to active positions when the machine is abruptly shut down. The movable inlet plow portion and the emergency side flap folding means are coupled to move into their active positions by a single actuator.

Finally, still another feature of the present invention relates to the use made of the emergency side flap folding means to support the partially folded side flaps of the tray blank in an intermediate position between the flat or planar configuration of the tray blank and the folded configuration achieved in the folding and compression section. A fixed ramp is provided upstream of the glue station for achieving this partial folding of the side flaps, and the partially folded side flaps are then supported by the emergency side flap folding means at the glue station.

BRIEF DESCRIPTION OF THE DRAWINGS

A more complete understanding of the present invention and many of the advantages thereto will be readily appreciated as the same becomes better understood by reference to the following detailed description when considered in conjunction with the accompanying drawings.

DETAILED DESCRIPTION OF THE PREFERRED EMBODIMENT

Figure 1A:
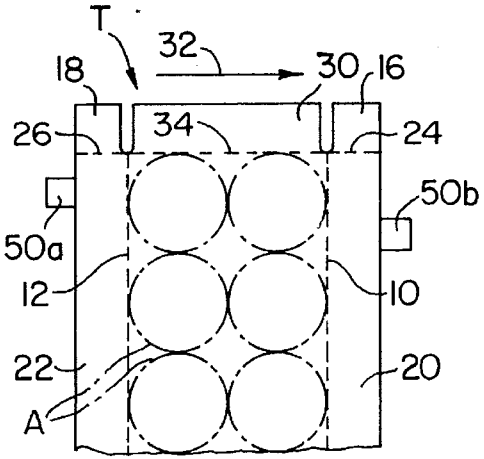
FIG. 1A is a top plan view showing one side portion of a tray blank, the fold lines being indicated in broken lines, and the group of articles loaded on the tray blank being illustrated in phantom lines.
Figure 1B:
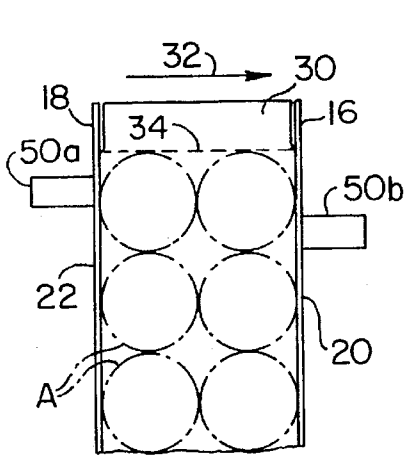
FIG. 1B is a view similar to FIG. 1A but showing the leading and trailing flaps of the tray in folded positions abutting the articles being packaged.
Figure 1C:
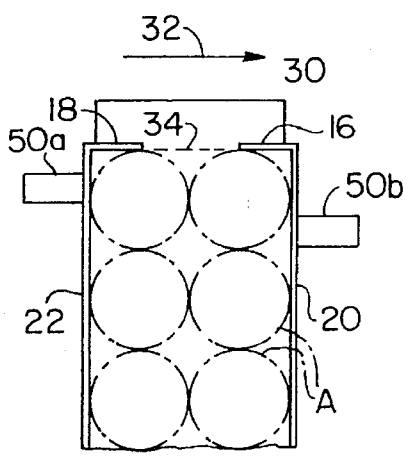
FIG. 1C is a view similar to FIGS. 1A and 1B but illustrating the corner tabs of the leading and trailing flaps folded inwardly against the articles to be packaged.
Figure 2A:
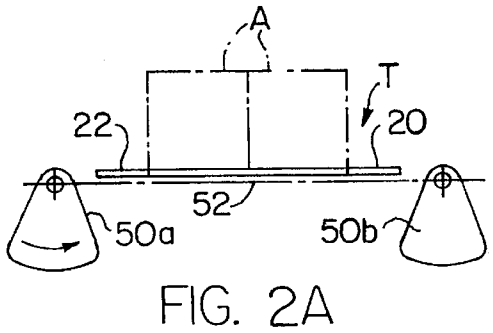
FIG. 2A is a side elevational view corresponding to FIG. 1A.

Turning now to the drawings in greater detail, and referring specifically to FIGS. 1A–2C inclusively, a tray blank T is shown in FIGS. 1A and 2A with a load of articles A,A provided on its bottom panel. The bottom panel is defined in part by the fold lines 10 and 12 associated with the leading and trailing flaps 20 and 22 of the tray T. These leading and trailing flaps 20 and 22 include corner tabs 16 and 18 respectively which are connected to the leading and trailing flaps 20 and 22 by score lines 24 and 26. Only one side of the tray blank T is illustrated in FIGS. 1A–2C, but it will be apparent that the other side constitutes a mirror image thereof.

The side flap 30 of the tray blank T is oriented in the direction of motion 32 of the tray blank as it travels downstream through the machine. This side flap 30 is connected to the tray blank T by score line 34. The score lines 34, 10 and 12 cooperate with one another to define the bottom panel of the tray blank that is loaded with a slug or group of articles A,A. The articles provide a mandrel around which the various flaps of the tray blank are folded in the machine. The leading and trailing flaps 20 and 22 are folded by rotatable lugs 50*a* and 50*b* provided for this purpose on the underlying pocket chain conveyor system which transports the tray blanks and its load of articles in the downstream direction through the packaging machine. FIG. 1A illustrates these lugs 50*a* and 50*b* and FIG. 1B illustrates these lugs after they have been rotated relative to the chains on which they are mounted to fold the leading and trailing flaps 20 and 22 into the general U-shape depicted in FIG. 2B.

Figure 2B:
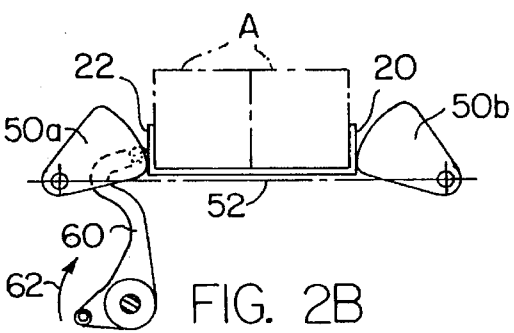
FIG. 2B is a side elevational view corresponding to FIG. 1B but also illustrating the rotating corner tab folding device that is rotated in the direction of the arrow.
Figure 2C:
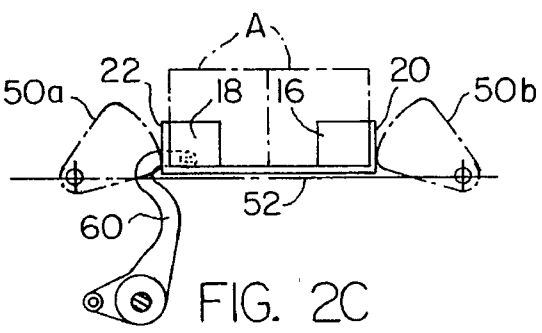
FIG. 2C is a view similar to FIG. 2B but illustrating the corner tab folding device after it has folded the corner tab inwardly against the articles.

FIGS. 2A, 2B and 2C illustrate the action of these lugs 50*a*,50*b* in the pocket chain conveyor system represented schematically by the broken line 52. Once the leading and trailing flaps 20 and 22 have been folded by the pocket-chain conveyor lugs 50*a*,50*b* a goose neck shaped corner tab folding device 60 rotates in the direction of the arrow 62 at a speed greater than that of the pocket chain conveyor 52 so as to fold the corner tab 18 associated with the trailing side flap 22 inwardly against the articles A,A provided on the bottom panel of the tray blank as shown in FIG. 1C. The leading corner tab 16 associated with the leading flap is folded by a fixed plow (not shown) in accordance with conventional practice.

Figure 3:
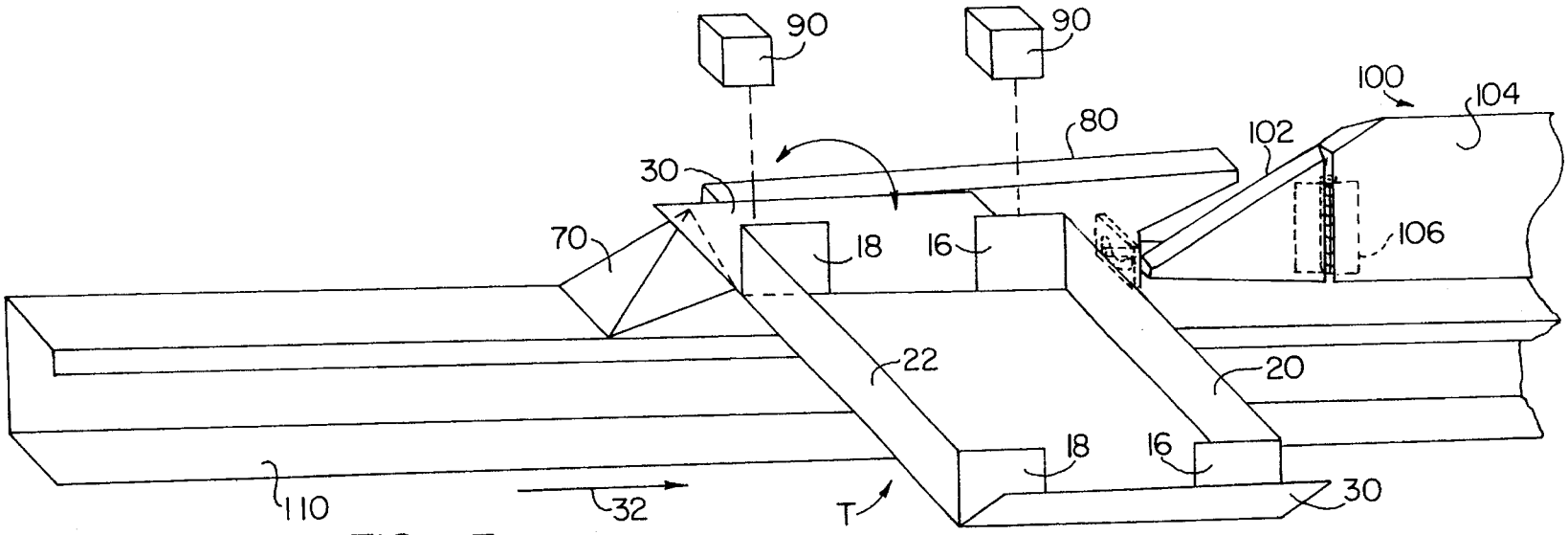
FIG. 3 is a schematic perspective view showing one side of a machine and one tray blank as it moves downstream through the glue station during normal operation.

Turning now to a more detailed description of the apparatus of the present invention for gluing and folding the end flaps 30 against these inwardly folded corner tabs 16, 18, FIG. 3 shows the tray blank T in a partially folded configuration proceeding downstream in the direction of the arrow 32. The end flap 30 associated with the far end of the tray blank T in FIG. 3 is partially folded by a ramp 70. The end flap 30 is held in this partially folded position by an emergency end flap folding means 80 located at the glue station suggested by the two glue guns 90,90 in FIG. 3. These glue guns 90,90 apply glue to an area of the partially folded side flap 30 which will eventually be brought into contact with the corner tabs 16,18 by a compression section of the machine indicated generally at 100 in FIG. 3. As the tray T is moved downstream by the pocket chain conveyor referred to previously, the side flaps 30,30 are glued at the glue station and then folded inwardly toward the corner tabs 16,18 by an inlet plow portion 102 of the compression section 100 which is canted slightly outwardly to receive the partially folded side flap 30. The side flap 30 is ultimately folded into a generally vertical position against the corner tabs 16,18 in the compression section 100.

Figure 4:
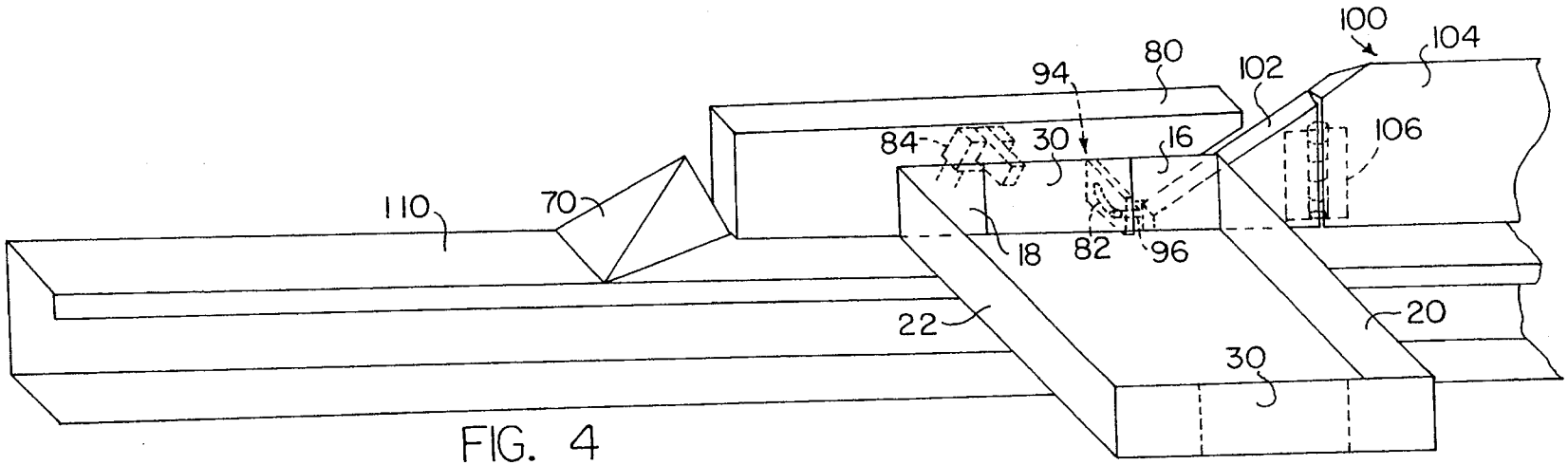
FIG. 4 is a view similar to FIG. 3 but illustrating the tray blank stopped at the glue station as a result of an abrupt machine shut-down.

Since the glue applied by the nozzles 90,90 is generally of the quick setting variety, the present invention seeks to provide a convenient means for completing this folding operation short of the compression section 100 if required, as for example in the event of an emergency or abrupt shutdown of the machine itself. The means for accomplishing this result preferably comprises the emergency flap folding means 80. This emergency flap folding means 80 is moveable from the position shown in FIG. 3 to a position where it is aligned with the compression section side wall 104 of the compression section 100 as shown in FIG. 4. Thus, the tray T can be stopped in the position shown in FIG. 4 at the glue station itself, and movement of the flap folding means 80 into this vertical position closes end flaps 30,30 against the corner tabs 16,18 without necessity for the tray to continue in a downstream direction into the compression section 100.

Figure 6:
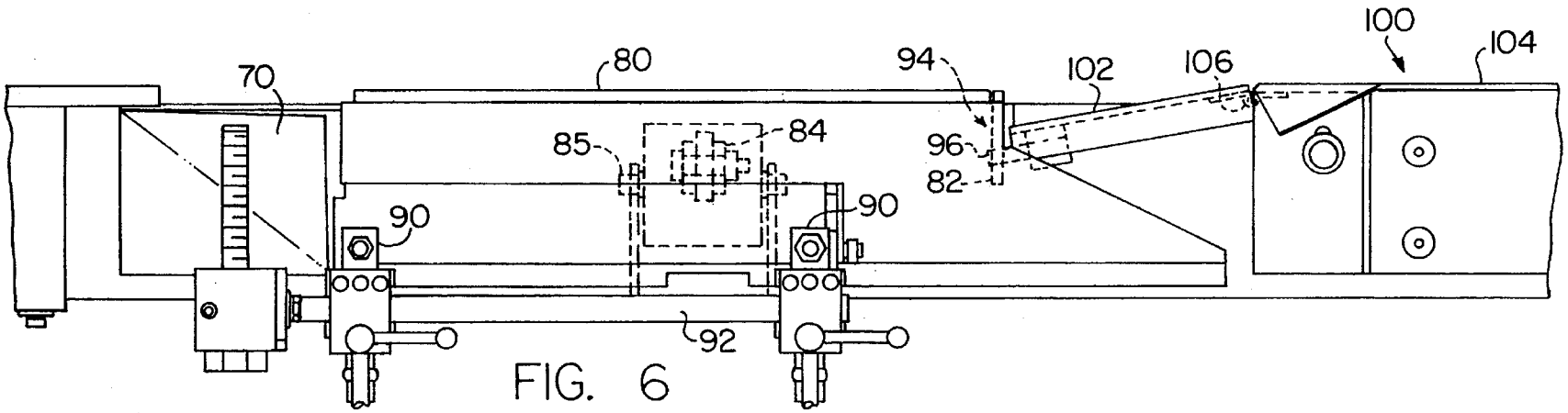
FIG. 6 is a top plan view of the apparatus illustrated in FIG. 5.

The inlet plow portion 102 of compression section 100 is normally canted relative to the downstream direction of the tray T as best shown in FIGS. 3 and 6. However, this inlet plow portion is adapted to move from this canted or normal position into alignment with the vertical sidewall 104 of compression section 100. The emergency flap folding means 80 is coupled to the inlet plow portion 102 so that the same motion referred to previously for the emergency flap folding means 80 also moves the inlet plow portion into a vertical position. The emergency flap folding means 80 and the inlet portion 102 of the compression section are coupled to one another for this purpose, preferably by a pin and slot connection as indicated generally at 94 in FIG. 4. More specifically, the inlet portion 102 is hinged to the upstream end of the fixed portion 104 of the compression section 100 by conventional hinge means indicated generally at 106 in FIGS. 3 and 4. The free end portion of the inlet plow portion 102 carries a pin 96 which is received in a camming slot provided for this purpose in the downstream end of emergency flap folding plow 80. This slot defining portion of the plow 80 is indicated generally at 82 in FIG. 4. The means for moving the emergency flap folding plow 80 comprises an actuator or air cylinder which is connected to the back side of the emergency flap folder 80 by a clevis, indicated generally at 84 in FIG. 4

Turning now to the detailed views FIGS. 5–11 of the preferred embodiment which has just been described with reference to the schematic views of FIGS. 1–4 inclusively, it will be apparent that the present invention resides in a packaging machine of the type adapted to handle groups of articles on individual trays moving in a downstream direction under the control of a conveyor. FIG. 10 shows in vertical elevation the configuration for this conveyor. Two pairs or sets of conveyors $52_a$ and $52_b$ are provided on associated sprockets driven by independent drive shafts and sprocket assemblies. A phase adjustment knob 55 is provided to adjust the pitch distance between the chains $52_a$ and $52_b$ so that the actual tray engaging pocket lugs $50_a$ and $50_b$ engaging the front or leading flap and rear or trailing flap of the tray T can be adjusted to accommodate trays of different size. Note that the shaft $54_a$ and its associated sprocket $53_a$ drive chain $52_a$ associated with the pocket lugs $50_a$. On the other hand, a tubular shaft $54_b$ and associated sprockets $53_b$ drive the inner set of chains $52_b$ and associated inner pocket defining slugs $50_b$. A differential unit 56 is provided between these shafts $54_a$ and $54_b$ with the result that rotation of the knob 55 on the exterior of the machine frame can be used to vary the pitch distance between the forward and rear pocket defining lugs $50_a$ and $50_b$.

Still with reference to FIG. 10 the fixed frame of the machine has laterally extending ways supporting the facing channel shaped beams 110,110. These beams 110 support the fixed compression sidewall members 104 104 referred to previously Also supported from these beams 110,110 are glue station nozzles 90,90 arranged in pairs and adapted to spray glue on the opposed side flaps 30 of the packing case tray T as it is moved in the downstream direction by the above described pocket chain conveyor lug elements. One or more lead screws are rotated as suggested at 55 to move the beams toward and away from one another to accommodate trays of different width.

Figure 5:
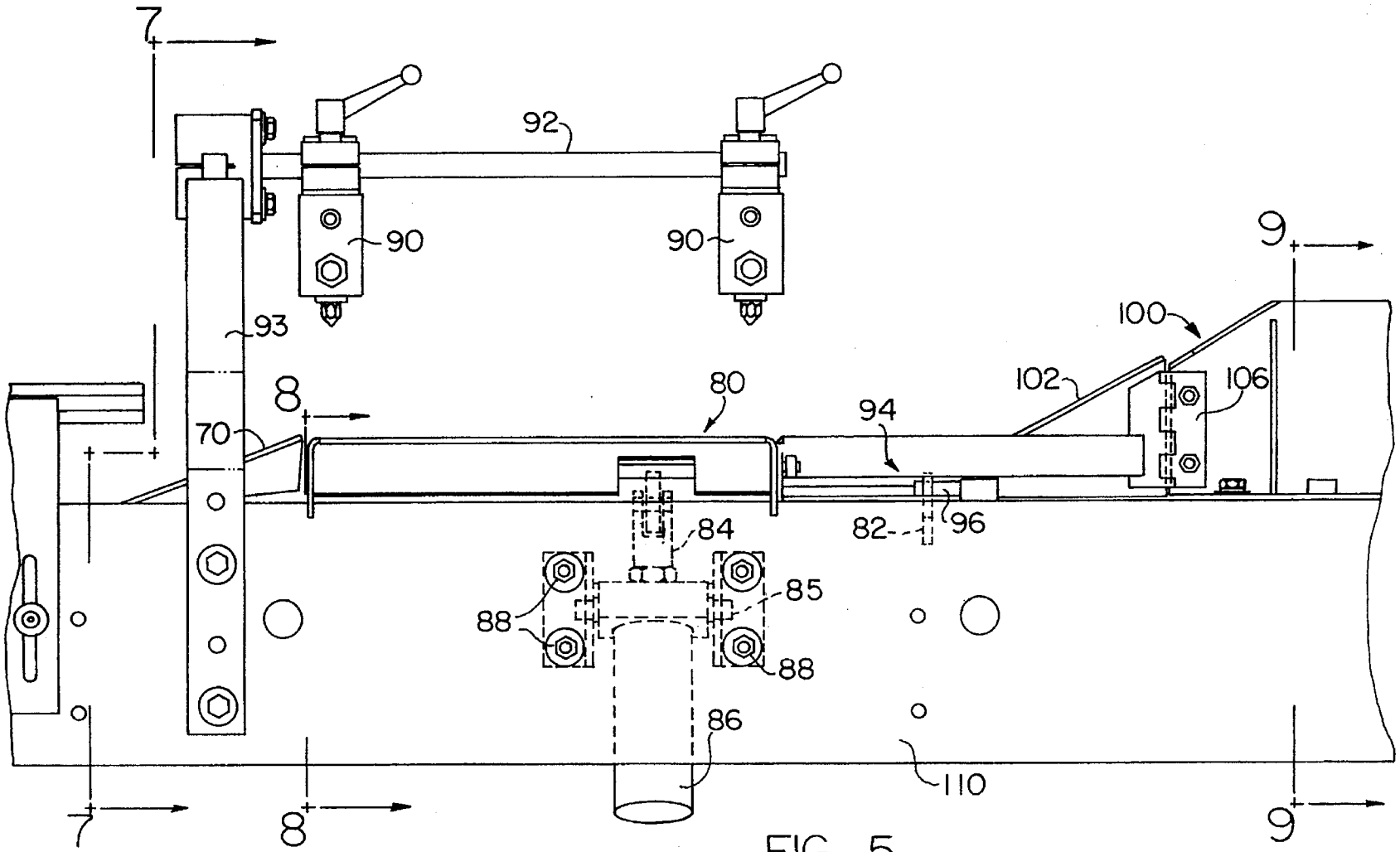
FIG. 5 is a side elevational view of one side of the glue station and the entry to the compression section in a packaging machine equipped with a flap folding mechanism in accordance with the present invention.

FIG. 5 shows these glue nozzles 90,90 mounted adjustably on an elongated support shaft 92. The support shaft 92 is in turn cantilevered from an upright support member 93. This arrangement permits adjustments to be made in the location for the glue nozzles 90,90 longitudinally relative to the emergency flap folding means 80. The emergency side flap folding means 80 is shown as comprising two sections bolted together so as to be driven together from the inactive position shown to the active position described previously with reference to FIG. 4 by an actuator 86. The actuator 86 includes a fixed portion mounted to the beam 110 by four screws 88,88 so that its moveable actuator portion is adapted to move the emergency side flap folding means 80 by reason of its connection to the clevis fitting 84 referred to previously.

Figure 8:
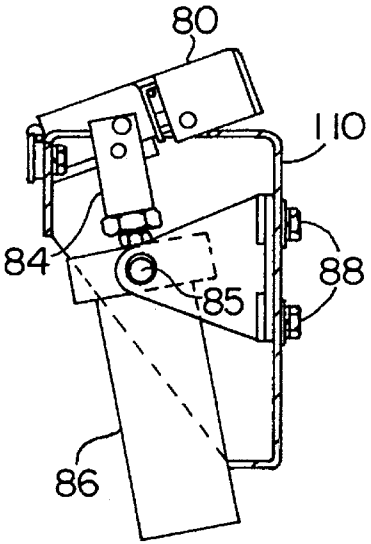
FIG. 8 is a vertical section taken generally on the line 8—8 of FIG. 5.

Turning next to the plan view of FIG. 6, the clevis fitting 84 provided for connection to the moveable actuator portion is there shown together with the pivotal connection 85 provided for the actuator 86 to permit generally arcuate motion of the emergency flap folding means 80. FIG. 8 illustrates the emergency flap folding means 80 in its normal or inactive position so that it acts as a shelf to support the partially folded side flap as described previously with reference to FIG. 3 above.

Figure 7:
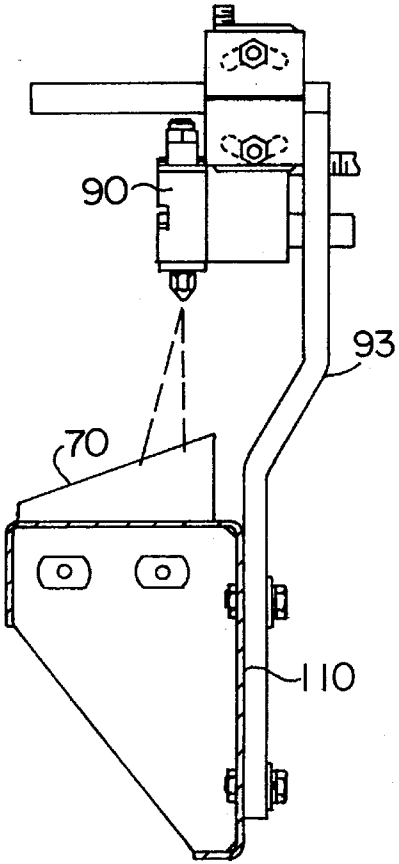
FIG. 7 is a vertical section taken generally on the line 7—7 of FIG. 5.

FIG. 7 shows the ramp portion 70 at the glue station. FIG. 6 also shows this ramp portion 70, and the emergency side flap folder 80 that moves between its normal position as shown to the emergency position described previously with reference to FIG. 4 above.

The actuator 86 is shown in FIG. 8 pivotally mounted at 85 to the fixed machine frame or beam 110 as a result of the U-shaped support bracket provided for this purpose and held in place by the four bolts 88,88. The emergency flap folding means 80 is shown in FIG. 8 in its normal or inactive position where it is adapted to support the tray side flap during gluing. FIG. 7 shows the glue nozzle 90 mounted on its support structure for spraying glue on the tray side flap which is so supported on the emergency side flap folding means 80.

Figure 9:
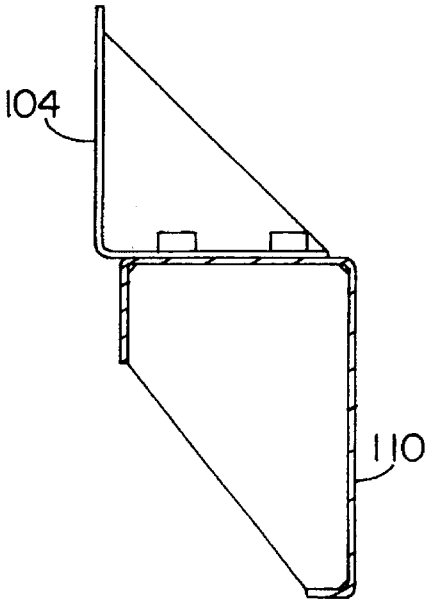
FIG. 9 is a vertical section taken generally on the line 9—9 of FIG. 5.
Figure 10A:
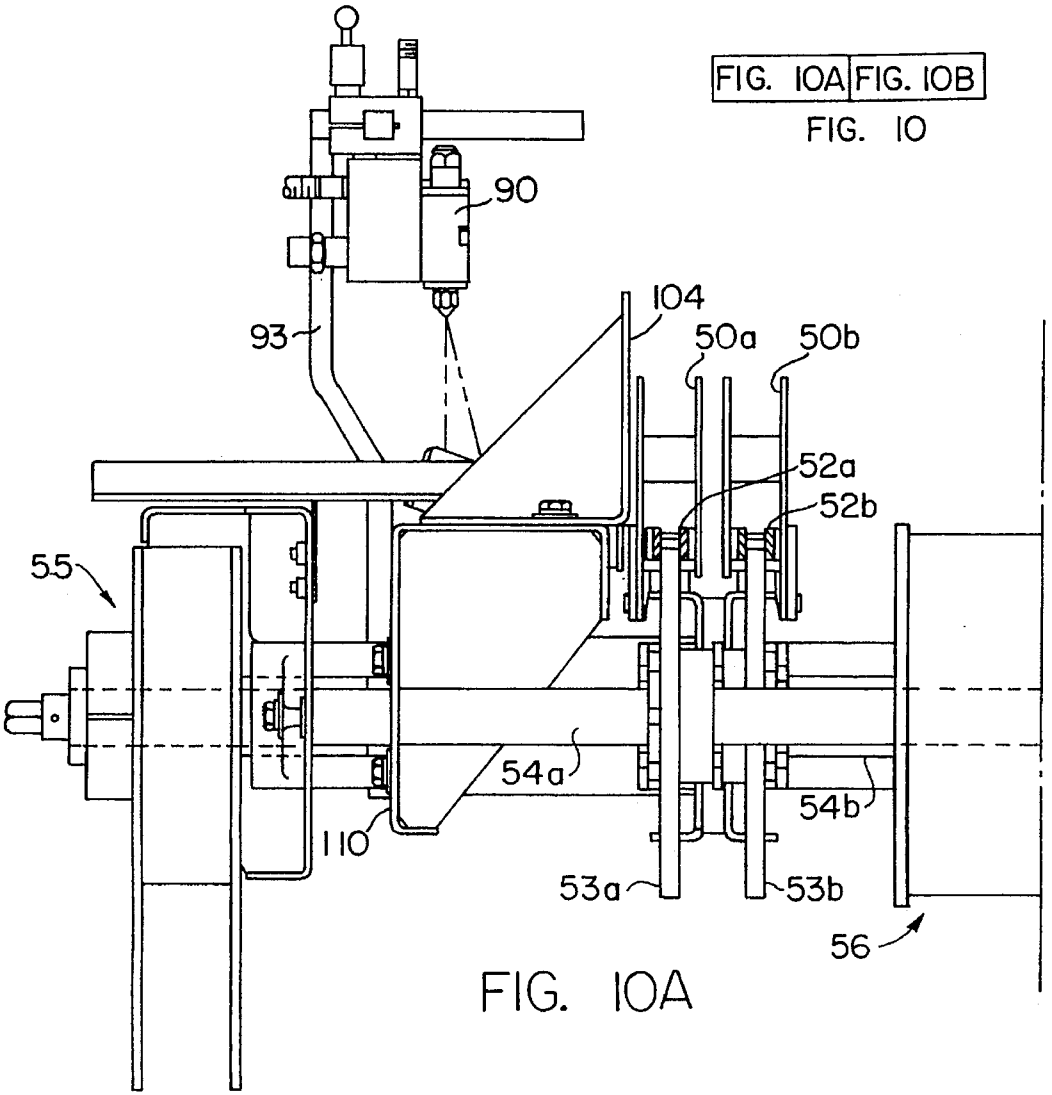
FIG. 10 is an end view looking upstream into the packaging machine depicted in FIGS. 5–9.
Figure 10B:
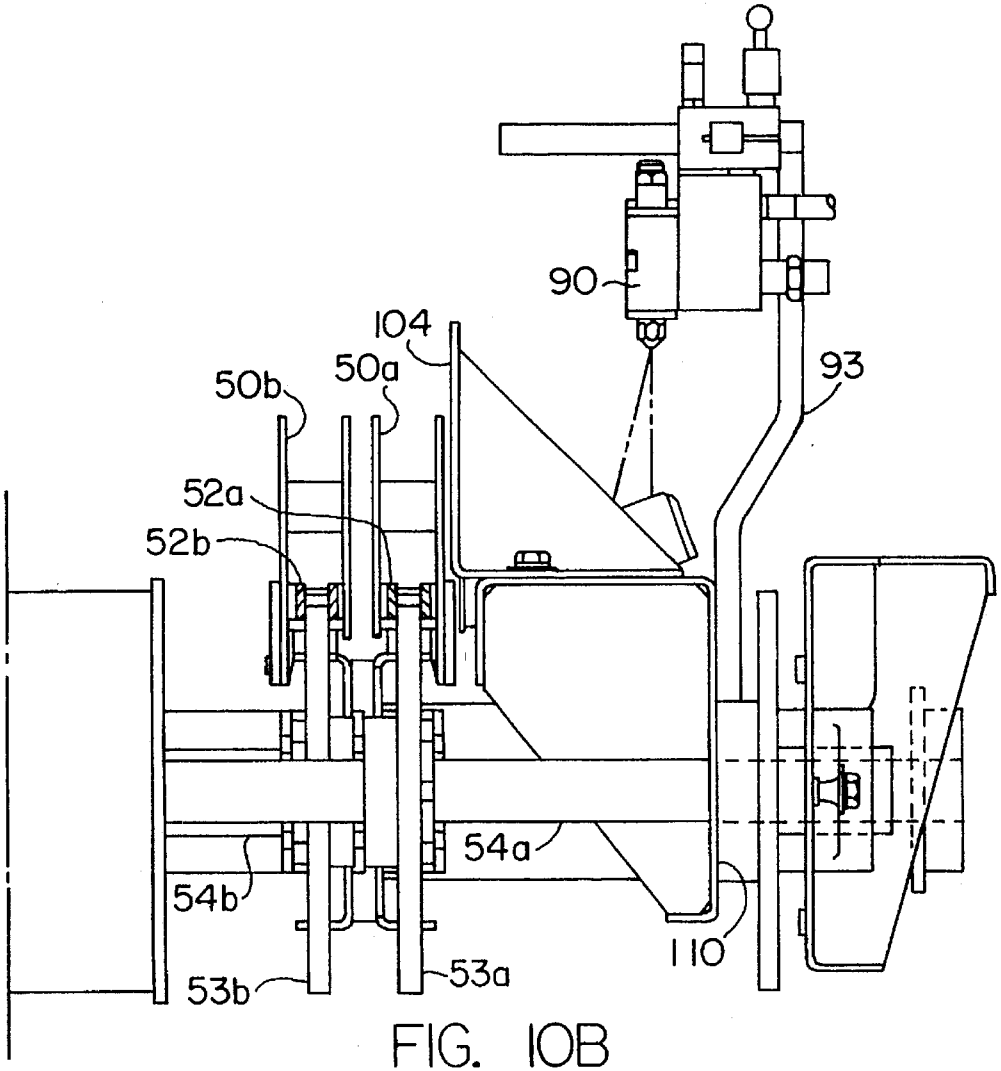

FIG. 9 shows the support provided on the beam 110 for the fixed compression section sidewall 104.

Figure 11A:
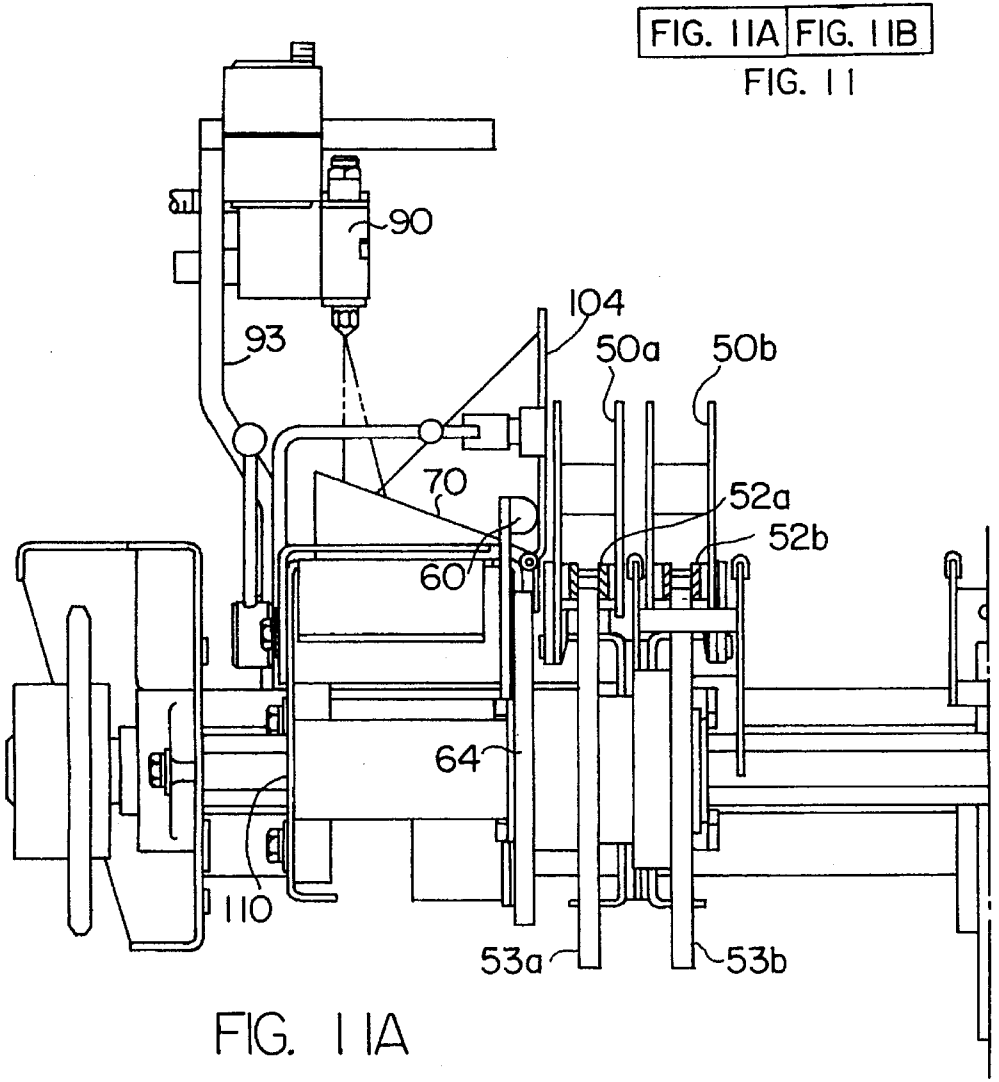
FIG. 11 is an end view looking downstream into the packaging machine of FIG. 10.
Figure 11B:
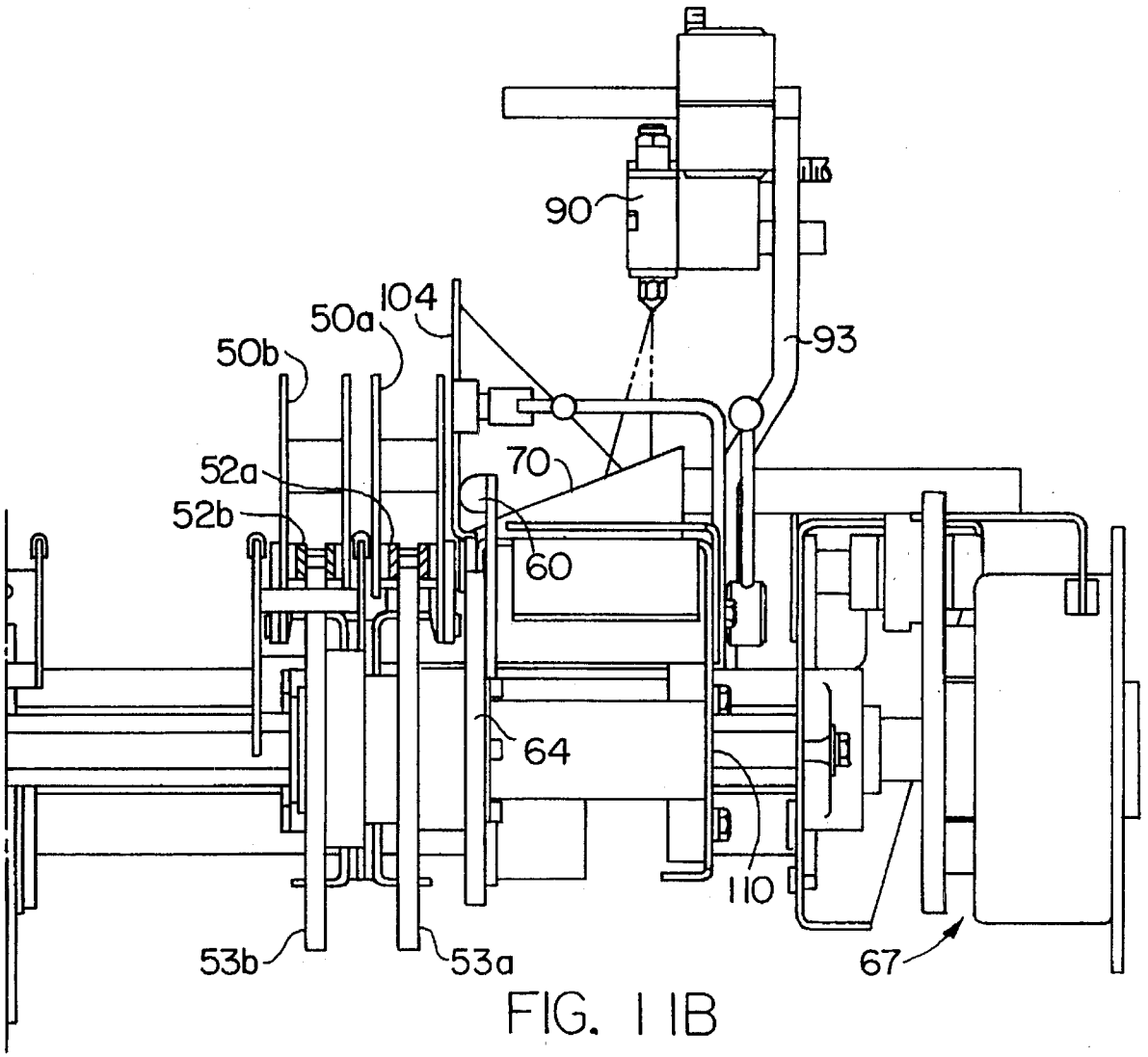
Figure 12:
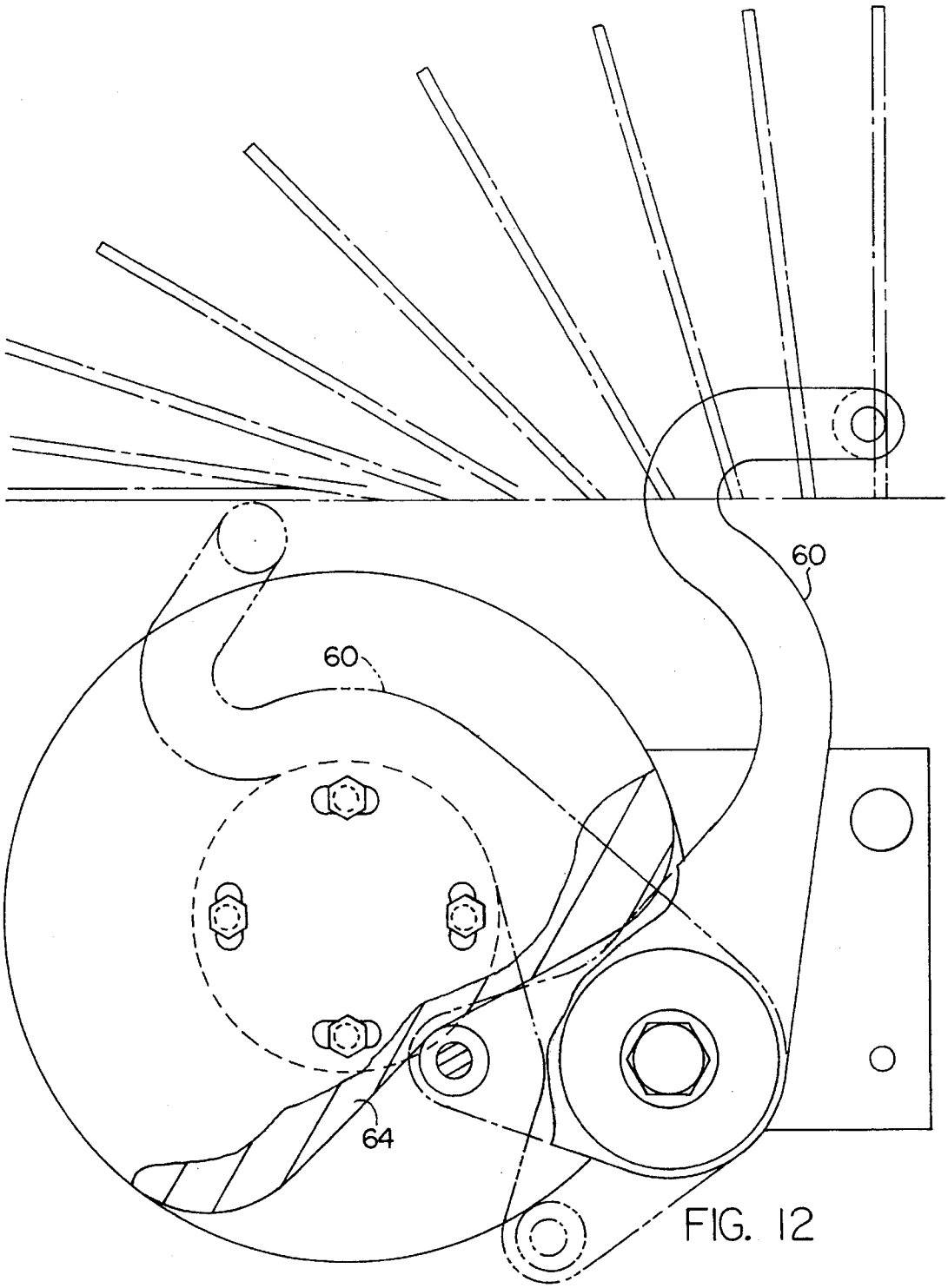
FIG. 12 is a schematic view of one corner tab folding device such as shown in FIGS. 2B and 2C.

FIG. 11 illustrates in a view looking downstream the configuration for the corner tab folding device 60 and its associated rotary cam 64, FIG. 11 shows these devices relative to the path of the tray on the pocket chain conveyor. The timing for the tucker 60 is adjusted by phaser 67. Finally, FIG. 12 shows the motion achieved for this corner tab folding device 60 as the cam 64 rotates in timed relationship with operation of the pocket chain conveyor drive.

We claim:

1. In a packaging machine for moving flat tray blanks downstream from a load station where articles are deposited on a bottom panel of the tray blank; the improvement comprising: a pocket chain conveyor system comprising one set of spaced chains carrying a first front flap folding pocket lug pair, and a second set of spaced chains carrying a second pair of rear flap folding pocket lugs, and a differential unit provided between said chains associated with said first and second pairs of pocket lugs, said differential unit including phase adjustment means to vary the pitch distance between said first and second pairs of pocket lugs to accommodate trays of different dimensions.

2. A packaging machine according to claim 1, wherein said first and said second pairs of pocket lugs are rotatably supported on said one and said second sets of chains respectfully, each pocket lug pair being rotatably mounted for movement between an inactive position below said one and second said of spaced chains and an active position above said chains whereby the front and rear flaps are folded relative the bottom panel of the tray blank into a general U-shape.

3. The packaging machine according to claim 2, wherein the tray blank includes side flaps, said machine fitted including side flap folding plows, said plows including fixed portions defining a compression section and said side flap folding plows including movably mounted inlet portions normally located to define a funnel shaped inlet for the side flaps.

4. The machine according to claim 3, further characterized by means for moving said side flap folding plows and said compression section toward and away from one another to accommodate trays of different widths.

5. The machine according to claim 4, wherein said inlet plow portions are hingedly connected to said fixed side flap folding plow portions of said compression section.

6. The machine according to claim 3, further comprising side flap gluing means for applying glue to the side flaps at a glue station downstream of said load station, said glue applying means and said compression section both being movable together toward and away from one another to accommodate trays of different width.

* * * * *